United States Patent [19]

Beer et al.

[11] Patent Number: 4,797,182

[45] Date of Patent: Jan. 10, 1989

[54] ELECTRODE WITH A PLATINUM METAL CATALYST IN SURFACE FILM AND ITS USE

[75] Inventors: Henri B. Beer, Heide-Kalmthout; Dirk Arnouts, Essen, both of Belgium

[73] Assignee: ELTECH Systems Corporation, Boca Raton, Fla.

[21] Appl. No.: 37,661

[22] Filed: Apr. 13, 1987

[30] Foreign Application Priority Data

Apr. 17, 1986 [EP] European Pat. Off. ..... 86105300.7

[51] Int. Cl.[4] ..... C25D 1/00

[52] U.S. Cl. ..... 204/14.1; 204/128; 204/290 F

[58] Field of Search ..... 204/290 F, 290 R, 128, 204/14.1

[56] References Cited

U.S. PATENT DOCUMENTS

| | | | |
|---|---|---|---|
| 3,234,110 | 2/1966 | Beer | 204/290 F |
| 3,632,498 | 1/1972 | Beer | 204/290 |
| 3,711,385 | 6/1973 | Beer | 204/59 |
| 3,776,834 | 12/1973 | O'Leary | 204/290 |
| 3,875,043 | 4/1975 | Franks et al. | 204/290 |
| 3,878,083 | 4/1975 | DeNora et al. | 204/290 |
| 4,157,943 | 6/1974 | Scarpellino et al. | 204/290 F |
| 4,203,810 | 5/1980 | Warne et al. | 204/290 F |
| 4,481,097 | 11/1984 | Asano et al. | 204/290 |

FOREIGN PATENT DOCUMENTS

| | | |
|---|---|---|
| 0046447 | 2/1982 | European Pat. Off. . |
| 964913 | 7/1964 | United Kingdom . |
| 1399576 | 5/1973 | United Kingdom . |
| 1463553 | 2/1977 | United Kingdom . |
| 2096173 | 10/1982 | United Kingdom . |

*Primary Examiner*—Richard L. Andrews
*Attorney, Agent, or Firm*—John J. Freer

[57] ABSTRACT

An electrode for use in electrolytic processes having a substrate of film-forming metal comprises an electrocatalyst incorporated in an integral surface film of the film-forming metal oxide grown from the substrate. The electrocatalyst incorporated in the integral surface film comprises two superimposed layers, a first layer comprising platinum metal and a second layer comprising an oxide of iridium, rhodium, palladium or ruthenium, the first platinum containing layer being next to the substrate and the second iridium, rhodium, palladium or ruthenium oxide containing layer being at the outer surface of the integral surface film of the film-forming metal oxide. The electrode comprising the two superimposed layers may be further coated with another electrochemically active catalytic outer layer in which case said superimposed layers serve as the electrode underlayer. The electrode is particularly useful as an oxygen evolving anode in high speed electroplating (electrogalvanizing).

9 Claims, No Drawings

ELECTRODE WITH A PLATINUM METAL CATALYST IN SURFACE FILM AND ITS USE

TECHNICAL FIELD

The invention relates to an electrode for use in electrolytic processes having a substrate of film-forming metal comprising an electrocatalyst incorporated in an integral surface film of the film-forming metal oxide grown from the substrate. The electrocatalyst incorporated into the integral surface film comprises at least one platinum-group metal and platinum-group metal oxide. The invention is particularly but not exclusively concerned with an electrode suitable for use as an oxygen anode in high speed electroplating (electrogavanizing).

BACKGROUND ART

Lifetimes of electrodes with a relatively small amount of the active material in the coating (e.g. less than 7.5 $g/m^2$) rapidly decrease with an increase in current density. In general, an early failure of an electrode is attributed to two major factors, loss of the active coating and dissolution, or in case of the film-forming metals, passivation of the substrate. Sometimes these occur simultaneously and the electrode at the end of its lifetime may show some active material left in the coating but the substrate passivated. A common solution to the problem of loss of the active component in the coating and passivation of the substrate, in the art, is use of thicker coatings i.e. higher loadings of the active component. Thicker coatings produced by brushing onto the substrate several (e.g. ten-twenty) layers of the active coating proved beneficial for lifetimes of the electrodes with the same coating composition. Simplicity of the solution to the problem of electrode lifetimes made thicker coatings a popular and almost universal remedy. However, this simple approach is found effective only up to a point and under certain electrochemical conditions (e.g. relatively low current densities, less corrosive environments, etc.) In addition, an increase of the coating thickness means a significant increase in cost.

The problem of electrode lifetime is particularly important with oxygen evolving electrodes used as anodes in various industrially important electrochemical processes e.g. metal electrowinning, electroforming, electroflotation, and electrosynthesis. In these processes, electrodes with platinum-group metal oxide coatings are used as oxygen evolving anodes. These platinum metal oxide anodes are found to operate very well under relatively difficult conditions imposed by these processes (e.g. current densities of up to 2–3 $kA/m^2$ in aggressive electrolytes). However, to attain an acceptable performance, under these conditions, these electrodes must have relatively high platinum-group metal loadings (e.g more than 4.5–7 $g/m^2$). Various tests with the known oxygen evolving anodes have shown, however, that while electrodes with platinum-group metal oxides operate with satisfaction under these conditions they fail rapidly if the operating current density is increased to 5 $kA/m^2$ or more. The simple approach of a higher loading therefore meant only higher costs but not better service life. In recent years, the rapid development of high speed plating (electrogalvanizing) techniques has amplified the problem.

It has been known from U.S. Pat. No. 3,711,385 that the electrocatalytic coating of a platinum-group metal oxide could be made as thin as 0.054 micrometers. In practice, however, it has been found that to achieve any acceptable lifetime somewhat thicker coatings were necessary. Hence, usually ten to twenty thin coatings of a suitable paint solution are applied to the film-forming metal base and heated each time to give an electrocatalytic coating formed from the decomposed component of the paint containing about 5 to 20 grams by metal of the platinum-group metal oxide per square meter of the projected electrode surface.

Many attempts have been made to ecomonize on the precious metal content of these coatings, usually, by partly replacing the platinum-group metal oxide by a compatible non-precious metal oxide such as tin dioxide (see for example U.S. Pat. No. 3,776,834) or tin and antimony oxides (see for example U.S. Pat. No. 3,875,043).

Another electrode for oxygen-evolution is that described in GB No. 1 399 576, having a coating containing a mixed crystal of tantalum oxide and iridium oxide. However, known electrodes of this type contain at least about 7.5 $g/m^2$ of iridium so that despite their excellent performance in terms of over-voltage and lifetime, the high cost of iridium makes these electrodes less attractive.

The electrode proposed in GB No. 1 463 553 has a base which consts entirely or at its surface of an alloy of a film-forming metal and an activating metal for instance a platinum-group metal, whose surface is oxidized during use or is preactivated by an oxidizing treatment to form in the outer part of the alloy a surface oxide layer to a depth of 1 to 30 micrometers. Such alloys have shown promise for electrowinning but are quite difficult to prepare by sintering or in another manner and are quite expensive because of the quantity of platinum-group metal in the alloy. Also, the pre-activation methods are difficult to control to obtain an improvement in the electrode performance.

An electrode with a titanium substrate and an active platinum/iridium metal coating has been disclosed in GB No. 964 913. The electrode is produced by thermal decomposition of platinum and iridium compounds in a reducing atmosphere at 350° C. By modifying this process it has been possible to produce coatings of platinum and iridium oxide.

An oxygen evolving anode made by coating a titanium substrate with iridium oxide or iridium/ruthenium oxide using a mixture of codedeposited titanium oxide or tin oxide and tantalum oxide or niobium oxide with platinum metal as the electrode underlayer has been disclosed in U.S. Pat. No. 4,481,097. The electrode active component includes 1.3 $g/m^2$ of platinum metal in the underlayer and 3.0 $g/m^2$ of iridium oxide in the toplayer. According to the document the electrode has maximum life time of 80 hours under accelerated lifetime tests performed in an aqueous solution with 150 g/l of $H_2SO_4$ as an electrolyte at 80° C. and current density of 25 $kA/m^2$.

An electrode with a titanium substrate and an electrocatalyst which preferably comprises up to 0.5 $g/m^2$ of iridium oxide and/or rhodium oxide per projected electrode surface has been disclosed in EP No. 0 046 447. According to the disclosure the electrocatalyst is formed as an integral surface film of an oxide or another compound of titanium metal which is grown from the substrate which incorporates iridium oxide and/or rhodium oxide as electrocatalyst. The electrode is produced using a method in which a solution of thermally decomposable compound of iridium and/or rhodium and an agent which attacks the metal of the substrate are applied to the titanium substrate and the coated structure then heated in air at 500° C. A superior performance for the electrode disclosed over the previous oxygen evolving anodes was demonstrated for processes in which the electrode was used at current densities between 500 and 1000 A/m$^2$. It could not be suspected that electrodes produced according to the principle disclosed in this teaching could prove to be useful and have an outstanding lifetime in processes operating at a high current density

DISCLOSURE OF THE INVENTION

It has now been found that when a platinum-group metal oxide electrocatalyst incorporated in an integral surface film of the film-forming metal oxide grown from the substrate is deposited over a layer of platinum metal which also forms a part of the integral surface film but is applied before the platinum-group metal oxide electrocatalyst layer, the lifetime of the electrode thus produced is significantly increased. It has been observed that as much as one order of magitude longer lifetimes may be obtained over the lifetimes of known oxygen evolving anodes with the same amount of the active material on their surface.

The main aspects of the invention as set out in the accompanying claims are based on the finding that the lifetime of electrodes with a film-forming metal substrate and a platinum-group metal based electrocatalyst incorporated in an integral surface film of the film-forming metal oxide grown from the substrate is considerably increased when the electrocatalyst in the surface film comprises two superimposed layers, a first layer comprising platinum metal and a second layer comprising an oxide of iridium, rhodium, palladium or ruthenium, the first platinum containing layer being next to the substrate and the second iridium, rhodium, palladium or ruthenium oxide containing layer coforming the outer surface of the integral surface film with the film-forming metal oxide. As will be shown in comparative examples below, the presence of the super-imposed layers in the surface oxide film produces a remarkable increase of the electrode performance. Although this surprising result cannot be adequately explained from the performance of the individual components it seems apparent that some synergistic effect of the superimposed layers of platinum and platinum group metal oxide occurs.

The electrode base may be a sheet of any film-forming metal such as titanium, tantalum, zirconium, niobium, tungsten and silicon, and alloys containing one or more of these metals titanium being preferred for cost reasons. By "film-forming metal" is meant a metal or alloy which has the property that when connected as an anode in the electrolyte in which the coated anode is subsequently to operate, there rapidly forms a passivating oxide film which protects the underlaying metal from corrosion by electrolyte, i.e. those metal and alloys which are frequently referred to as "valve metals", as well as alloys containing valve metal (e.g. Ti-Ni, Ti-Co, Ti-Fe and Ti-Cu) but which in the same conditions form a non-passivating anodic surface oxide film. Rods, tubes, wires or knitted wires and expanded meshes of titanium or other film-forming metals can be used as the electrode base. Titanium or other film-forming metal clad on a conducting core can also be used. It is also possible to surface treat porous sintered titanium with the dilute paint solutions in the same manner.

For most applications, the base will be etched prior to the surface treatment, but in some instances the base may simply be cleaned, and this gives a very smooth electrode surface. Alternatively, the film-forming metal substrate can have a preapplied surface film of film-forming metal oxide which during application of the active coating is attacked by an agent in the coating solution (e.g. HCl) and reconstituted as a part of the integral surface film.

Excellent results with the electrodes according to the invention are obtained when the electrocatalyst in the surface film in the two superimposed layers are partially interdiffused. Most usually, such interdiffusion will be confined to an intermediate part of the adjacent layers where the platinum metal of the underlayer intermingles with the oxide toplayer, the outer surface consisting of the iridium, rhodium, palladium and/or ruthenium oxide together with film-forming metal oxide from the substrate. In other words, the platinum metal underlayer should not extend to the outer surface of the film even if all or part of the platinum metal underlayer may be interdiffused into the subsequently-applied oxide layer, depending mainly on the loading of platinum metal.

Typically the electrode of the invention has between 4 and 4.5 g/m$^2$ in total of the platinum metals and may achieve lifetimes of several thousand hours at current densities well above 10 kA/m$^2$ and in extremely corrosive environments. This total loading is considerably above the loadings of up to 2 g/m$^2$ obtained previously according to the teaching of EP No. 0 046 447. For some unknown reason it appears that the provision of two superimposed layers with platinum underneath enables higher metal loadings to be incorporated in the surface film. Furthermore, this has been shown to produce an exponential increase of useful service lifetime as a function of a simple increase in the catalyst loading.

It has been established that the optimal amount of platinum in the first platinum containing layer is between 0.8 and 1.8 g/m$^2$ of the projected surface. The optimal amount is the amount in terms of the electrode performance vis-a-vis the cost of platinum metal. Clearly, electrodes of the invention may be produced with even more platinum in the first layer, however, this amount should not exceed 5 g/m$^2$. Similarly, electrodes with a smaller amount of platinum metal may be produced However, it has been found that the lowest practical limit of platinum metal in the first layer is 0.5 g/m$^2$. Difficulties of reproducibility of the electrode have been experienced with platinum concentrations below 0.5 g/m$^2$. The amount of the platinum-group metal oxide in the second layer is preferably between 2 to 4 g/m$^2$ (calculated as metal) of the oxide of iridium, rhodium, palladium or ruthenium This range is regarded as optimal in cost-benefit terms, however, good results may be obtained with as low as 1 g/m$^2$ and up to 5 g/m$^2$ of $IrO_2$, calculated as metal.

It has also been established that excellent results are obtained with electrodes made using titanium as the electrode substrate when titanium oxide grown from the substrate is in the form of solid solution with the oxide in the second layer This is particularly true when the oxide of the second layer is iridium oxide and when the molar ratio of platinum metal to iridium oxide in the surface film is between 1:1 and 1:6 (calculated as metal).

The electrode disclosed may be used directly as an oxygen evolving anode or may serve as a substrate for various types of known coatings in which case the two superimposed platinum metal/oxide containing layers serve as an underlayer for another electrochemically active catalytic coating applied by known methods including chemideposition, electroplating and plasma spraying. The coatings which may be used as a topcoatings are well known. Examples are $RuO_2/TiO_2$ or modified $RuO_2/TiO_2$ coatings including $SnO_2/RuO_2/TiO_2$, $Sb_2O_3/RuO_2/TiO_2$, $SnO_2/Sb_2O_3/RuO_2/TiO_2$, $IrO_2/RuO_2/TiO_2$ and $CoO_3/SnO_2/RuO_2/TiO_2$. Further examples are Pt, Pt/Ir, $Pt/IrO_2$, $IrO_2$, $Ta_2O_5/IrO_2$ as well as non-precious metal oxide coatings including $MnO_2$, $PbO_2$, $Sb_2O_3$, and $Co_3O_4$ depending on the intended application. Further details of such coatings are for example described in U.S. Pat. Nos. 3,632,498, 3,776,834, 3,711,385, 3,875,043 3,878,083, and GB No. 964 913. An example of a non-precious metal oxide topcoating is the lead dioxide topcoating as described in GB No. 2 096 173A applied to the improved substrate described herein.

The electrode disclosed is excellently suited for use as an oxygen evolving anode in electrochemical processes at high current densitites (i.e. over 3.5 kA/m$^2$) for prolonged periods of time. An example of such a process is high speed electroplating (electrogalvanizing).

The electrode according to the invention is further illustrated in the following examples:

EXAMPLE I

Coupons measuring 7.5×2 cm of titanium were decreased and etched for ½ hour in a 10% aqueous solution of oxalic acid at 85° to 95° C. Two paint solutions were prepared: one paint solution (a) consisting of 10 g/l of platinum metal and 10% of HCl (concentrated) in isopropanol, and a second paint solution (b) consisting of $IrCl_3$ in 10% of HCl (concentrated) in isopropanol. The concentration of iridium metal present in the paint was 50 g/l. First three coatings of the platinum containing paint solution (a) were applied, and then a further three layers of the iridium containing paint (b) were painted on, the coupons were heated in air to 500° C. for 10 minutes after each coating and the samples produced heated in air at 500° C. for 30 minutes after the final coating.

The electrodes obtained, having a loading of 1.3 g/m$^2$ of platinum metal and 3.0 g/m$^2$ of iridium oxide, were tested as anodes in 150 g/l of H at 80° C. and in 12N NaOH at 95° C. with a current density of 25 kA/m$^2$. Outstanding lifetimes of 760 and 114 hours in the respective solutions were obtained under these severe conditions (sample $A_2$ in Table 2). Comparative tests given in Table 2 for the electrodes of the invention and electrodes of the prior art have shown that the best result for a comparable prior art eectrode under the same conditions gave only 80 hours in $H_2SO_4$ for the electrode with $Pt\text{-}Nb_2O_5\text{-}TiO_2$ underlayer (sample $C_2$ in Table 2). It is believed that this surprising increase of the electrode lifetime comes from the combined effect of the two superimposed layers formed as an integral part of the electrode surface. It has also been found that lifetimes of the electrodes prepared according to this example tested in 150 g/l of sulfuric acid under a current density of 15 kA/m$^2$ exceed 2100 hours.

EXAMPLE II

Titanium coupons were degreased, rinsed in water dried ad etched, and then surface treated as in Example I with subsequent application of paint solutions containing (a) 0.1 g of chloroplatinic acid ($H_2PtCl_6.6H_2O$) and (b) rhodium chloride and solutions containing (a) 0.1 g of chloroplatinic acid ($H_2PtCl_6.6H_2O$) and (b) palladium chloride. The amount of catalyst in the surface treated electrodes after application of twice four coatings was calculated to be 1.3 g/m$^2$ of Pt, as metal, and 3.0 g/m$^2$, as metal, of rhodium oxide or palladium oxide. When such electrodes are tested as anodes in 150 g/l $H_2SO_4$ at 80° C. and in 12N NaOH at 95° C. with a current density of 25 kA/m$^2$ excellent lifetimes are obtained.

COMPARATIVE EXAMPLE I

A titanium coupon was degreased, rinsed in water, dried and etched for ½ hour in a 10% aqueous solution of oxalic acid. A paint solution consisting of 0.5 g $IrCl_3.H_2O$, 3 ml isopropanol and 0.2 ml HCl (concentrated) was then applied by brush to both sides of the coupon. The coupon was then dried and heated in air at 480° C. for ten minutes. The coating procedure was repeated twice, and the resulting $IrO_2$ coating had a loading of approximately 2.1 g/m$^2$ of iridium. The coating solution and procedure used are considered to be conventional. The resulting electrode was subjected to an accelerated lifetime test in 150 g/l sulphuric acid at a current density of 15 kA/m$^2$; its lifetime was 150 hours.

COMPARATIVE EXAMPLE II

Coupons measuring 7.5×2 cm of titanium were degreased and etched for ½ hour in a 10% aqueous solution of oxalic acid at 85° to 95° C. Three paint solutions were prepared. One solution consisted of 0.1 g iridium chloride, 5 ml isopropanol and 0.4 ml HCl (concentrated), the second containing 0.1 g of chloroplatinic acid ($H_2PtCl_6.6H_2O$) and the third solution containing a mixture of 0.1 g of chloroplatinic acid ($H_2PtCl_6.6H_2O$) and iridium chloride. The coupons were then coated in an oxidizing atmosphere in the known way and electrodes with iridium oxide, platinum metal and codedeposited platinum/iridium oxide coatings produced. The electrodes obtained were subsequently tested as oxygen anodes in 150 g/l sulphuric acid at a current density of 15 kA/m$^2$. The lifetimes of $IrO_2$ (sample $B_2$ in Table 1), Pt, (sample $C_1$ in Table 1) and codedeposited $Pt/IrO_2$ (sample D1 in Table 1) obtained for these electrodes is compared with the electrode prepared in accordance with Example I (sample $A_1$ in Table 1). The electrodes $B_1$ and $C_1$ had a loading of the respective active component of 1 g/m$^2$ (as metal) and electrodes $A_1$ and $D_1$ of 2 g/m$^2$ of the respective active components (as metal).

TABLE 1

| Sample | $A_1$ | $B_1$ | $C_1$ | $D_1$ |
|---|---|---|---|---|
| Lifetime (hours) | 380 | 110 | 4 | 60 |

As shown the lifetime of sample $A_1$ (the electrode with 1 g/m$^2$ and 1 g/m$^2$ $IrO_2$ prepared according to the invention) is surprisingly much greater than that of sample $B_1$ (the electrode with 1 g/m$^2$ $IrO_2$), sample $C_1$ (the electrode with 1 g/m$^2$ Pt) and sample $D_1$ (the electrode with 2 g/m$^2$ of codeposited $PtIrO_2$ 70/30 mol %). In the test conditions, the lifetime of the electrode with platinum metal coating ($C_1$) is only 4 hours and the lifetime of the electrode with iridium oxide is 110 hours ($B_1$). However, when the two coatings are combined and applied in the known way i.e. when they are codeposited ($D_1$), the lifetime is only 60 hours. It follows that the presence of platinum metal codedeposited in the coating of $IrO_2$ reduces the electrode lifetime. When, on the other hand, the platinum metal/iridium oxide electrode is prepared according to the invention ($A_1$) its lifetime increases more than six fold in relation to $D_1$ and more than 3.5 fold in relation of $B_1$.

COMPARATIVE EXAMPLE III

The procedure of Example II of U.S. Pat. No. 4,481,097 was faithfully repeated following the described procedure. The electrodes with iridium oxide topcoating with 3 g/m$^2$of iridium as metal and an undercoating of Pt-$Ta_2O_5$-$TiO_2$ (sample $B_2$ in Table 2), Pt-$Nb_2O_5$-$TiO_2$ (sample $C_2$ in Table 2) and Pt-$Sn_2$-$TiO_2$-$Ta_2O_5$ (sample $D_2$ in Table 2). In these prior art electrodes, the platinum was codepositioned with the film-forming metal oxides as an underlayer with $IrO_2$ as a separate layer on top. All samples were prepared with 1.3 g/m$^2$ of platinum metal in the undercoating. The electrodes were submitted to the accelerated life tests described in the Example I and the results obtained listed in Table 2. In addition to results of accelerated life tests, data on the half cell potentials in 10% sulfuric acid obtained for the tested electrodes are also presented in Table 2. From the half cell potentials (in millivolts vs a Normal Hydrogen Electrode) it may be said that electrochemical activities of sample $A_2$, $C_2$ and $D_2$ under the same electrochemical conditions were very similar.

TABLE 2

| SAMPLE | $H_2SO_4$ 150 g/l 25 kA/m$^2$ 80° C. (hr) | NaOH 12 N 25 kA/m$^2$ 95° C. (hr) | Volts (NHE) 10% $H_2SO_4$ 5 kA/m$^2$ 80° C. (mV) |
|---|---|---|---|
| $A_2$ | 760 | 114 | 1590 |
| $B_2$ | 75 | 13 | 1890 |
| $C_2$ | 80 | 15 | 1630 |
| $D_2$ | 65 | 46 | 1630 |

From the results in this Table it follows that the electrode of the invention (sample $A_2$) showed one order of magnitude longer lifetime when compared to the lifetimes of the prior art electrodes (samples $B_2$–$D_2$) in $H_2SO_4$ with a similar improvement in 12N solution of caustic.

In the course of experimentation it has been established that adequate anchoring of the platinum metal is decisive for the electrode lifetime. Experimental results have shown that adequate anchoring is directly linked to the amount and morphology (quality) of titanium oxide from the electrode substrate. It has been established that with a properly developed platinum sublayer lifetimes of more than 1600 hours may be achieved (in sulfuric acid under test conditions described in Example I) using electrodes made using a sandwich of superimposed platinum metal/iridium oxide layers.

We claim:

1. An electrode for use in electrolytic processes having a substrate of film-forming metal comprising an electrocatalyst incorporated in an integral surface film of the film-forming metal oxide grown from the substrate, said electrocatalyst comprising at least one platinum-group metal and platinum-group metal oxide, characterized in that the electrocatalyst in the surface film comprises two superimposed layers, a first layer comprising platinum metal and a second layer comprising an oxide of iridium, rhodium, palladium, and or ruthenium, the first platinum containing layer being next to the substrate and the second iridium, rhodium, palladium or ruthenium oxide containing layer coforming the outer surface of the integral surface film with the film-forming metal oxide.

2. The electrode according to claim 1, characterized in that the first platinum metal comprising layer and the second iridium oxide, rhodium oxide, palladium oxide or ruthenium oxide containing layer are partially interdiffused.

3. The electrode according to claim 1, characterized in that the first layer comprises 0.8 to 1.8 g/m$^2$ of platinum metal.

4. The electrode according to claim 1 characterized in that the second layer comprises 2 to 4 g/m$^2$ of the oxide of iridium, rhodium, palladium or ruthenium (calculated as metal).

5. The electrode according to claim 1, characterized in that the film-forming metal oxide is titanium oxide grown from a titanium substrate and the oxide in the second layer is iridium oxide, at least a major part of said titanium oxide and said iridium oxide being in the form of solid solution.

6. The electrode according to claim 5, characterized in that the molar ratio of platinum metal to iridium oxide in the surface film is between 1:1 and 1:6 (calculated as metal).

7. The electrode according to claim 1, characterized in that the surface film comprising the two superimposed layers serves as an underlayer for another electrochemically active catalytic outer layer.

8. The method of carrying out an electrolytic process wherein oxygen is evolved at an anode during said process at a current density exceeding 3.5 kA per m$^2$ of projected anode surface, which method comprises contacting with an electrolyte an electrode and connecting said electrode as an anode, said electrode being manufactured by providing an electrode substrate of film-forming metal, and then establishing an integeral surface film of film-forming metal oxide grown from the substrate, said electrode manufacture including incorporating electrocatalyst in said surface film, said electrocatalyst comprising two superimposed layers, with a first layer containing platinum metal and a second layer containing an oxide of iridium, rhodium, plalladium or ruthenium, with said first layer being next to the substrate and said second layer coforming the outer surface of the intergral surface film with the film-forming metal oxide.

9. The method of claim 8, wherein the high current density electrolytic process is high speed electroplating.

* * * * *